US009048080B2

(12) United States Patent
Verenchikov et al.

(10) Patent No.: US 9,048,080 B2
(45) Date of Patent: Jun. 2, 2015

(54) TIME-OF-FLIGHT MASS SPECTROMETER WITH ACCUMULATING ELECTRON IMPACT ION SOURCE

(75) Inventors: Anatoly N. Verenchikov, St. Petersburg (RU); Yuri Khasin, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 13/817,519

(22) PCT Filed: Aug. 18, 2011

(86) PCT No.: PCT/US2011/048198

§ 371 (c)(1),
(2), (4) Date: May 2, 2013

(87) PCT Pub. No.: WO2012/024468

PCT Pub. Date: Feb. 23, 2012

(65) Prior Publication Data

US 2013/0206978 A1 Aug. 15, 2013

Related U.S. Application Data

(60) Provisional application No. 61/375,115, filed on Aug. 19, 2010.

(51) Int. Cl.

| | |
|---|---|
| ***H01J 49/00*** | (2006.01) |
| ***H01J 49/14*** | (2006.01) |
| ***H01J 49/40*** | (2006.01) |

(52) U.S. Cl.

CPC ..... *H01J 49/147* (2013.01); *H01J 49/401* (2013.01); *H01J 49/0031* (2013.01)

(58) Field of Classification Search

CPC ..... H01J 27/02; H01J 27/024; H01J 27/20; H01J 27/205; H01J 27/18; H01J 49/127; H01J 49/20; H01J 49/22; H01J 49/40; H01J 49/401; H01J 49/403; H01J 49/405; H01J 49/406; H01J 49/427

USPC ..... 250/281, 282, 283, 285, 287

See application file for complete search history.

(56) References Cited

U.S. PATENT DOCUMENTS

| | | | | |
|---|---|---|---|---|
| 6,936,814 | B2 | 8/2005 | Hastings | |
| 2005/0023454 | A1 * | 2/2005 | Bateman et al. ..... | 250/288 |

(Continued)

FOREIGN PATENT DOCUMENTS

| | | |
|---|---|---|
| JP | 2002-25497 | 1/2002 |
| JP | 2007526596 A | 9/2007 |

(Continued)

OTHER PUBLICATIONS

Chen, Y.H., et al., "Orthogonal Electron Impact Source for a Time-of-Flight Mass Spectrometer with High Mass Resolving Power," International Journal of Mass Spectrometry, 1999, vol. 185-187, pp. 221-226, XP002670143.

(Continued)

*Primary Examiner* — Nicole Ippolito
*Assistant Examiner* — Jason McCormack
(74) *Attorney, Agent, or Firm* — Honigman Miller Schwartz and Cohn LLP

(57) ABSTRACT

An accumulating ion source for a mass spectrometer that includes a sample injector (328) introducing sample vapors into an ionization space (115) and an electron emitter (102) emitting a continuous electron beam (104) into the ionization space (115) to generate analyte ions. The accumulating ion source further includes first and second electrodes (108*a*, 108*b*) arranged spaced apart in the ionization space (115) for accumulating analyte ions substantially therebetween. The first and second electrodes (108*a*, 108*b*) receive periodic extraction energy potentials to accelerate packets of analyte ions from the ionization space (115) along a first axis. An orthogonal accelerator (140) receives the packets of analyte ions along the first axis and periodically accelerates the packets of analyte ions along a second axis substantially orthogonal to the first axis. A time delay between the extraction acceleration and the acceleration of each respective packet of analyte ions provides a proportional mass range of the respective packet of analyte ions.

27 Claims, 11 Drawing Sheets

(56) References Cited

U.S. PATENT DOCUMENTS

| | | | | |
|---|---|---|---|---|
| 2005/0109928 | A1* | 5/2005 | Hastings | 250/281 |
| 2006/0237641 | A1* | 10/2006 | Moeller et al. | 250/288 |
| 2007/0040131 | A1* | 2/2007 | Perkins | 250/492.21 |
| 2007/0176090 | A1* | 8/2007 | Verentchikov | 250/287 |
| 2007/0278417 | A1* | 12/2007 | Horsky et al. | 250/427 |
| 2009/0014644 | A1* | 1/2009 | Yang et al. | 250/288 |
| 2009/0314935 | A1* | 12/2009 | Hoyes | 250/283 |

FOREIGN PATENT DOCUMENTS

| | | | |
|---|---|---|---|
| WO | 0077823 | A2 | 12/2000 |
| WO | WO-2005001878 | A2 | 1/2005 |

OTHER PUBLICATIONS

Grix, R., et al., "An Electron Impact Storage Ion Source for Time-of-Flight Mass Spectrometers," International Journal of Mass Spectrometry and Ion Processes, 1989, vol. 93, pp. 323-330, XP002670144.

Gross, J.H., "Mass Spectrometry, A Textbook," Springer, Berlin, 2004, pp. 193-222, XP002670145.

International Search Report for PCT/US2011/048198, dated Feb. 22, 2012, four pages.

R. Grix, U. Gruner, G. Li, H. Stroh and H. Wollnik, " An election impact storage ion source for time-of-flight mass spectrometers". International Journal of Mass Spectrometry and Ion Processes, 1989, 93, 323-330.

Translation of Japanese Office Action for related application No. 2013-524974 dated Mar. 7, 2014.

Chinese Office Action for related application No. 201180040095.4 dated Dec. 29, 2014.

German Office Action for related application No. 112011102743.5 dated Dec. 3, 2014.

* cited by examiner

TIME-OF-FLIGHT MASS SPECTROMETER WITH ACCUMULATING ELECTRON IMPACT ION SOURCE

BACKGROUND

Electron impact (EI) ionization is widely employed by mass spectrometry for environmental analysis and technological control. Samples of interest are extracted from analyzed media, like food, soil or water. The extracts contain analytes of interest within rich chemical matrixes. The extracts are separated in time within single or two-dimensional gas chromatography (GC or GC×GC). A GC carrier gas, typically Helium, delivers the sample into an EI source for ionization by an electron beam. Electron energy is generally kept at 70 eV in order to obtain standard fragment spectra. Spectra are collected using mass spectrometer and then submitted for comparison with a library of standard EI spectra for identification of analytes of interest.

Many applications demand analysis at high level of sensitivity (e.g., at least under 1 pg and preferably at 1 fg level) and with a high dynamic range (e.g., at least 1E+5 and desirably at 1E+8) concentrations between low level analytes and rich chemical matrix. Data with high resolving power is generally sought for reliable compound identification and for improving of signal to chemical noise ratio.

Many GC-mass spectrometer systems employ quadrupole analyzers. Since EI spectra contain a multiplicity of peaks, it is generally necessary to use a scan mass analyzer over a wide mass range, which leads to inevitable ion losses in quadrupole mass analyzers, slows down spectra acquisition, and introduces skew in the shape of individual mass traces, distorting fragment intensity ratios. Since GC and in particular GC×GC separation provide short chromatographic peaks (e.g., under 50 ms in GC×GC case), a Time-of-flight mass spectrometer (TOF MS) is generally used for rapid acquisition of panoramic (full mass range) spectra when coupled with GC or GC×GC

SUMMARY

In general, a multi reflecting time-of-flight mass spectrometer that employs an electron impact ion source with an orthogonal acceleration is described. Advantageously, the disclosed spectrometer improves the combination of resolution, sensitivity and dynamic range in such systems by extracting packets of accumulated analyte ions out of the ionization space along a first axis, orthogonally accelerating the analyte ion packets along a second axis substantially orthogonal to the first axis; and synchronizing extraction of the ion packets with orthogonal acceleration of the ion packets with a time delay therebetween, wherein the time delay is proportional to a mass range of each extracted analyte ion packet.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
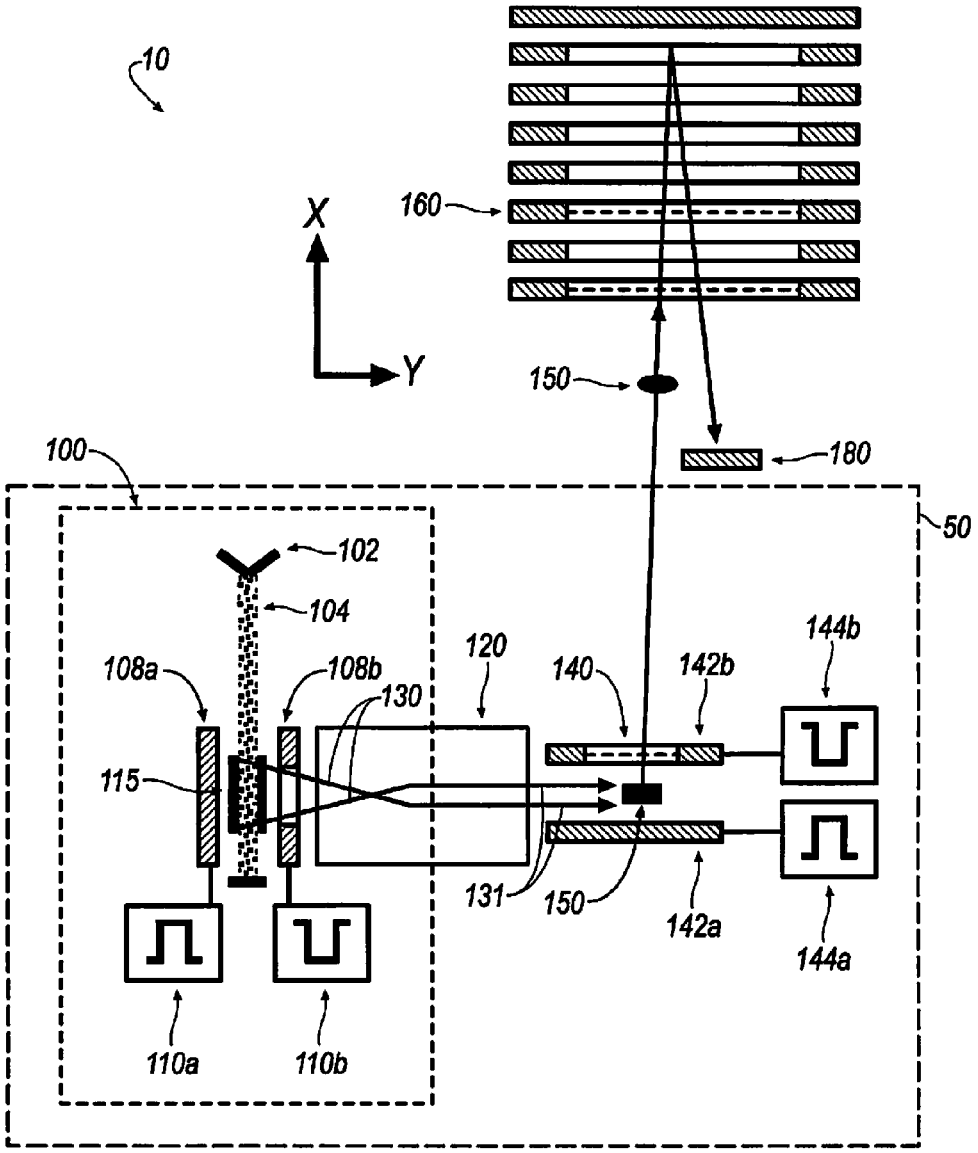
FIG. 1 is a schematic view of an exemplary time-of-flight (TOF) mass spectrometer system.

FIG. 1 provides a schematic view of an exemplary time-of-flight (TOF) mass spectrometer system 10 employing orthogonal acceleration in combination with ion accumulation within an electron impact (EI) ionization source. TOF mass spectrometer system 10 includes an accumulating electron impact ion source assembly 50 in communication with an ion mirror 160 and a detector 180. Accumulating electron impact ion source assembly 50 includes an accumulating ion source 100 in communication with transfer ion optics 120 and an orthogonal accelerator 140. Accumulating ion source 100 defines a first, X axis and a second, Y axis, orthogonal to the X axis. In some implementations, accumulating ion source 100 includes an electron emitter 102 (e.g., a thermo-emitter) delivering a continuous electron beam 104 into an ionization space 115 defined between first and second electrodes 108*a* and 108*b* connected to respective first and second pulsed generators 110*a*, 110*b*. In some implementations, electron emitter 102 accelerates electron beam 104 to between about 25 eV and about 70 eV, and/or delivers a current of at least 100 μA into the ionization space 115. Accumulating ion source 100 can be configured to accumulate ions within electron beam 104 (e.g., in ionization space 115) between extraction pulses from pulsed generators 110*a*, 110*b*.

Orthogonal accelerator 140 may include third and fourth electrodes 142*a* and 142*b* in electrical communication with respective third and fourth pulse generators 144*a* and 144*b*. Pulses from first and second pulse generators 110*a* and 110*b* are synchronized with orthogonal acceleration pulses from third and fourth generators 144*a* and 144*b* to admit a desired mass range of ion packets 150 for orthogonal acceleration by orthogonal accelerator 140. Orthogonally accelerated ion packets 150 can be received by a reflectron 160 (also known as an ion mirror), which uses a static electric field to reverse the direction of travel of received ions. Reflectron 160 improves mass resolution by assuring that ions of substantially the same mass-to-charge ratio, but different kinetic energy, arrive at a detector 180 in communication with reflectron/ion mirror 160 at the same time.

Figure 2:
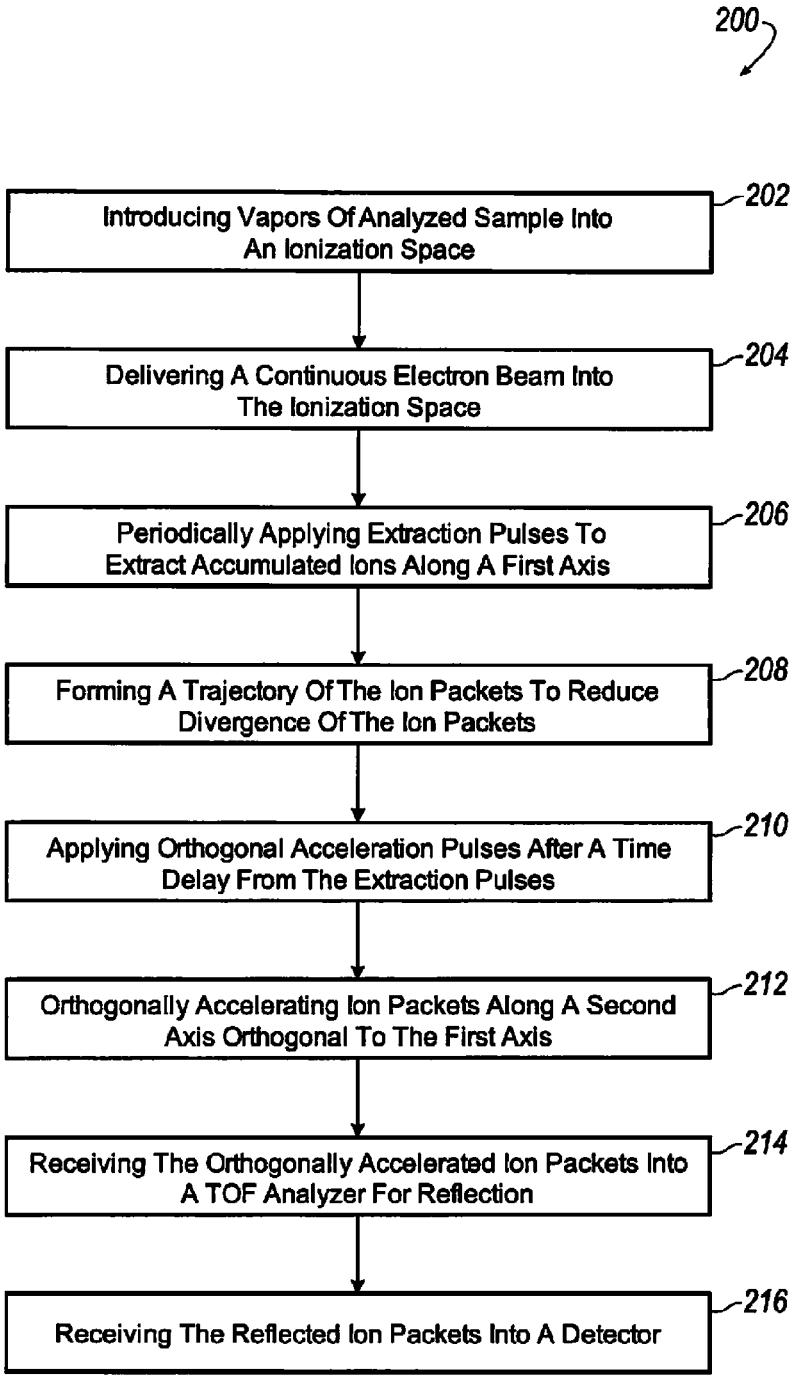
FIG. 2 is a schematic view of an exemplary arrangement of operations for operating the TOF mass spectrometer system.

FIG. 2 provides an exemplary arrangement 200 of operations for operating the TOF mass spectrometer system 10. The operations include introducing 202 vapors of analyzed sample (i.e., analyte) into ionization space 115 defined between first and second electrodes 108*a* and 108*b* and delivering 204 (e.g., accelerating) a continuous electron beam 104 into ionization space 115. For example, electron emitter 102 (e.g., a thermo-emitter) may deliver a continuous electron beam 104 of between about 25 eV and about 70 eV energy into ionization space 115 between first and second electrodes 108*a* and 108*b* to continuously produce ions of analyte in ionization space 115. For the purpose of enhancing sensitivity, accumulating ion source 100 can be arranged to accumulate ions within electron beam 104. In some examples, the operations include charging first and second electrodes 108*a* and 108*b* with potentials that assist ion accumulation within electron beam 104. Moreover, parameters of accumulating ion source 100, such as electron current and energy, rate of helium flow, and/or a diameter of an extracting aperture 108*b* defined by accumulating ion source 100 (e.g., in second electrode 108*b*) can be optimized to improve ion accumulation and collisional dampening of ions within accumulating ion source 100.

The operations include periodically applying 206 extraction pulses to first and second electrodes 108*a* and 108*b* to extract accumulated ions along the Y axis, for example, to form short ion packets 130 with an estimated packet duration of between about 0.5 μs and about 2 μs. The operations also include forming 208 a trajectory of ion packets 130 within transfer ion optics 120 so as to reduce divergence of ion packets 130 within orthogonal accelerator 140. The operations further include applying 210 orthogonal acceleration pulses (e.g., from third and fourth generators 144*a* and 144*b*) to third and fourth electrodes 142*a* and 142*b* after a time delay from the extraction pulses and orthogonally accelerating 212 ion packets 130 along the X axis. The time delay between the extraction acceleration of each packet of analyte ions 130 along the Y axis and the acceleration of each respective packet of analyte ions 150 along the X axis provides a proportional mass range of the respective packet of analyte ions 130. The orthogonal acceleration pulses may be sufficient for transferring a desired mass range of ion packets 130 from orthogonal accelerator 140 into a time-of-flight (TOF) analyzer 160 or ion mirror. Moreover, the operations may include receiving 214 orthogonally accelerated ion packets 150 into a TOF analyzer 160 for reflection and receiving 216 reflected ion packets 150 into a detector 180.

Typical energy of ion packets 130 in Y direction is between 20 and 100 eV, in order to form nearly parallel ion trajectories 131 within the accelerator 140 and to arrange a trajectory tilt of ion packet 150 towards the detector 180. Typical length in Y direction of the transfer ion optics 120 is in the order from 10 to 100 mm. Typical length in Y direction of the orthogonal accelerator 140 is from 10 to 100 mm. Within the flight path from ionization region 115 to the center of the orthogonal accelerator 140 there occurs time-of-flight separation—smaller ions reach the accelerator 140 faster than the heavier ones. To expand the ion mass range caught in the accelerator 140 at the time of the acceleration pulse of 114*a* and 144*b*, one should use shorter ion optics 120 in the order of 10 mm and a longer accelerator 140 above 50 mm, which would allow covering standard GC-MS mass range from 50 to 1000 amu. Contrary, to achieve higher resolution in the time-of-flight analyzer, one should form a nearly parallel ion beam which requires usage of longer ion optics with an optional ion beam collimation. The expected length of the ion optics is between 50 and 100 mm which would cause reduction of the admitted mass range. To choose a desired mass range, a delay between the extraction pulse of pulse generators 110*a*/110*b* and acceleration pulses of generators 144*a*/144*b* should be adjusted. Typical delay is in the order of 10 microseconds.

In one particular embodiment, the ion source 100 is of the "open" type as employed in Pegasus product line by LECO Corporation. The source is known for its robustness against contaminations. Compared to direct axial extraction in the Pegasus product, the proposed herein method of the delayed orthogonal extraction provides a time delay for decomposition of plasma formed in the ionization region. Besides, step 208 provides low divergent ion trajectories of ions within the orthogonal accelerator 140. Thus formed ion packets 130 should allow formation of shorter ion packets 150 at orthogonal acceleration compared to the direct pulsed extraction.

Figure 3:
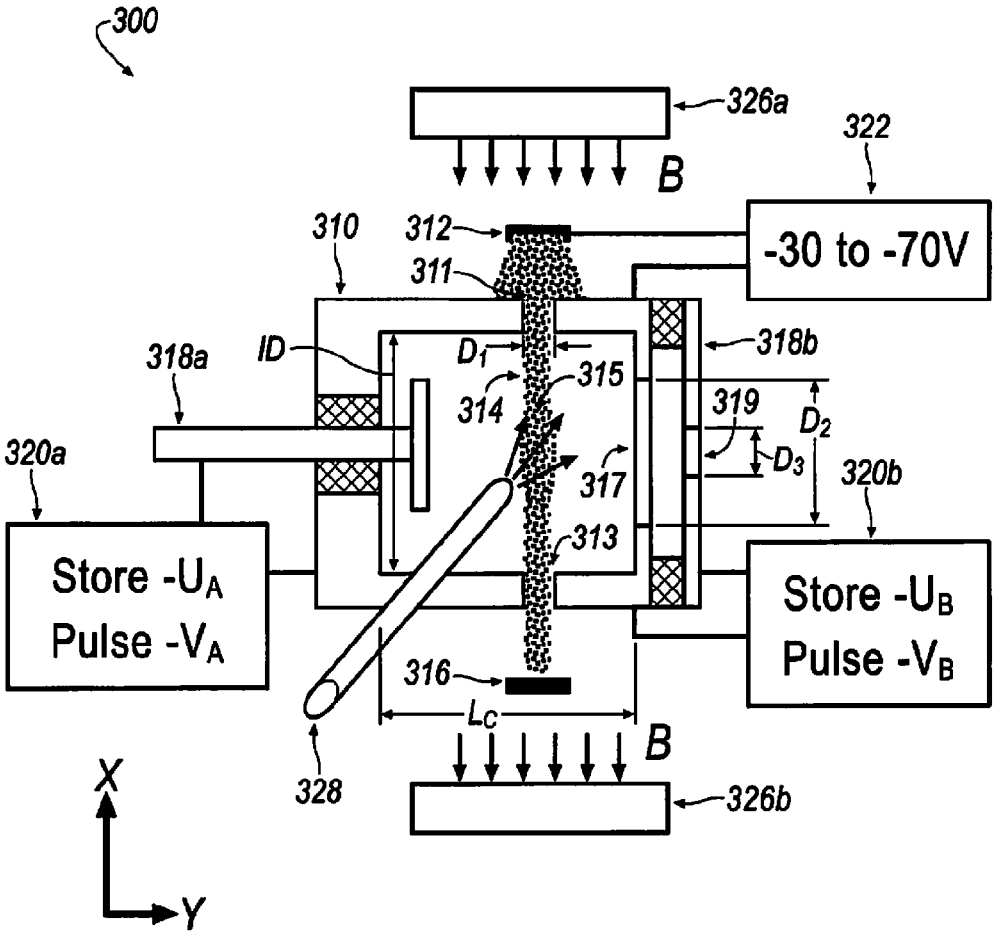
FIG. 3 is a schematic view of an exemplary closed type accumulating ion source.

FIG. 3 provides a schematic view of a "closed" type of accumulating ion source 300. Accumulating ion source 300 includes an ionization chamber 310 having an ionization region 315 and an electron emitter 312 delivering a continuous electron beam 314 into ionization region 315 (e.g., through a respective aperture defined by ionization chamber 310). In some examples, an electron collector 316 receives electron beam 314 (e.g., through a respective aperture defined by ionization chamber 310). In some implementations, ionization chamber 310 is cylindrical having an inner diameter ID (e.g., 13 mm) and a length $L_C$ (e.g., 10 mm). Ionization chamber 310 may define a beam entrance aperture 311 (e.g., having a diameter $D_1$ of between about 0.5 mm and about 3 mm) opposite a beam exit aperture 313. Beam entrance aperture 311 receives a sampling of electron beam 314 therethrough from electron emitter 312 and beam exit aperture 313 allows the exiting of electron beam 314 from ionization chamber 310 and receipt by electron collector 316.

Ionization chamber 310 defines a first, X axis and a second, Y axis, orthogonal to the X axis. A power supply 322, in electrical communication with electron emitter 312, energizes electron emitter 312 for producing electron beam 314. Ion source 300 also includes a first electrode 318*a* (a repeller) and a second electrode 318*b* (an extractor) disposed on opposite sides of ionization region 315. In some implementations, ionization chamber 310 defines an extraction aperture 317 (e.g., having a diameter $D_2$ of between about 1 mm and about 10 mm) and the second electrode 318*b* defines an exit aperture 319 (e.g., having a diameter $D_3$ of between about 2 mm and about 4 mm) for the extraction of ions from ionization region 315. Extraction aperture 319 may be sized to maintain a gas pressure in ionization chamber 310 of between about 1 mTorr and about 10 mTorr. In this case, ion beam storage can be accompanied by gaseous cooling of stored ions and spatial compression of an ion cloud.

First and second pulsed generators 320*a* and 320*b* in electrical communication with respective first and second electrodes 318*a* and 318*b* switch between a first set of storage voltages $U_A$ and $U_B$ during a storage stage and a second set of extraction voltages $V_A$ and $V_B$ during an extraction stage. Voltages $U_A$ and $U_B$ can be used to form a static quadrupolar field to substantially confine accumulated analyte ions in a radial direction. The static quadrupolar field may have a strength near the electron beam of less than 1 v/mm. First and second magnets 326*a* and 326*b* may be arranged on opposite sides of ionization region 315 for electron beam focusing. In the example shown, first magnet 326*a* is disposed proximate electron emitter 312 and second magnet 326*b* is disposed proximate electron collector 316. A transfer line 328 (also referred to as a sample injector) may be used for delivering a sample (i.e., analyte) into ionization space 315 from a gas chromatograph (not shown) in a flow of carrier gas, such as Helium (or Nitrogen, Hydrogen or some other noble gas, for example). Transfer line 328 may introduce carrier gas at a flow rate of between about 0.1 mL/min and about 10 mL/min to sustain a gas pressure of between about 1 mTorr and about 10 mTorr at exit aperture 319 diameter of between about 2 mm and about 4 mm.

In some implementations, for both accumulating and static modes of operation of accumulating electron impact ion source assembly 300, beam entrance aperture 311 has a diameter $D_1$ of about 1 mm and extraction aperture 317 has a diameter $D_2$ of between about 2 mm and about 4 mm and/or allows a gas flow of about 1 mL/min for maximizing sensitivity. An electron energy of 30 eV of electron beam 314 may suppress Helium ionization by at least three orders of magnitude and allow an analyte signal to rise by a factor of two or three, compared to an electron beam energy of 70 eV. The effect is due to a much higher ionization potential of Helium (PI=23 eV) compared to most of organics (e.g., PI=7-10 eV). The reduced electron energy expands the range of the helium flow rate without affecting operation parameters of accumulating ion source 300 (e.g., and may be related to a space charge of the helium ions).

To allow efficient ion accumulation within electron beam 314, a field structure in ionization region 315 may be set to avoid continuous ion extraction during the accumulation stage. Electric potentials $U_A$ and $U_B$ on first and second electrodes 318*a* and 318*b* can be set within a few volts of the potential of ionization chamber 310 to keep the field strength under 1V/mm. Moreover, electric potentials $U_A$ and $U_B$ may be maintained slightly attractive to allow compression of electron beam 314 along the X axis.

Electron beam 314 may have a current of at least 100 uA to provide sufficient space charge of electron beam 314. For a relatively higher signal and lower tolerance to Helium flux, electron beam 314 may have an energy of about 30 eV for suppressing Helium ionization (e.g., by at least 3 orders of magnitude). In some examples, electron collector 316 has slight positive voltage bias compared to electron emitter 312 in order to remove slow electrons formed during sample and Helium ionization.

In some implementations, the product of an accumulation time T in ionization region 315 and of sample flux F is less than 1 pg (T*F<1 pg) and, in some cases, less than 0.1 pg (T*F<0.1 pg). For example, for an accumulation time T of between about 0.5 ms and about 1 ms, analyzed flux F corresponds to a range of between about 1 fg/sec and about 100 pg/sec. At higher loads or higher accumulation time, the accumulated ion beam may overfill ionization region 315 and the ion accumulation within electron beam 314 disappears or is suppressed, thus lowering instrument sensitivity. By analyzing samples at relatively small loads or providing efficient time separation between target analyzed impurities and the sample matrix, relatively greater instrument sensitivity can be achieved. Two-dimensional gas chromatography (GC×GC) may provide sufficient time separation of analyte from matrix.

Figure 4:
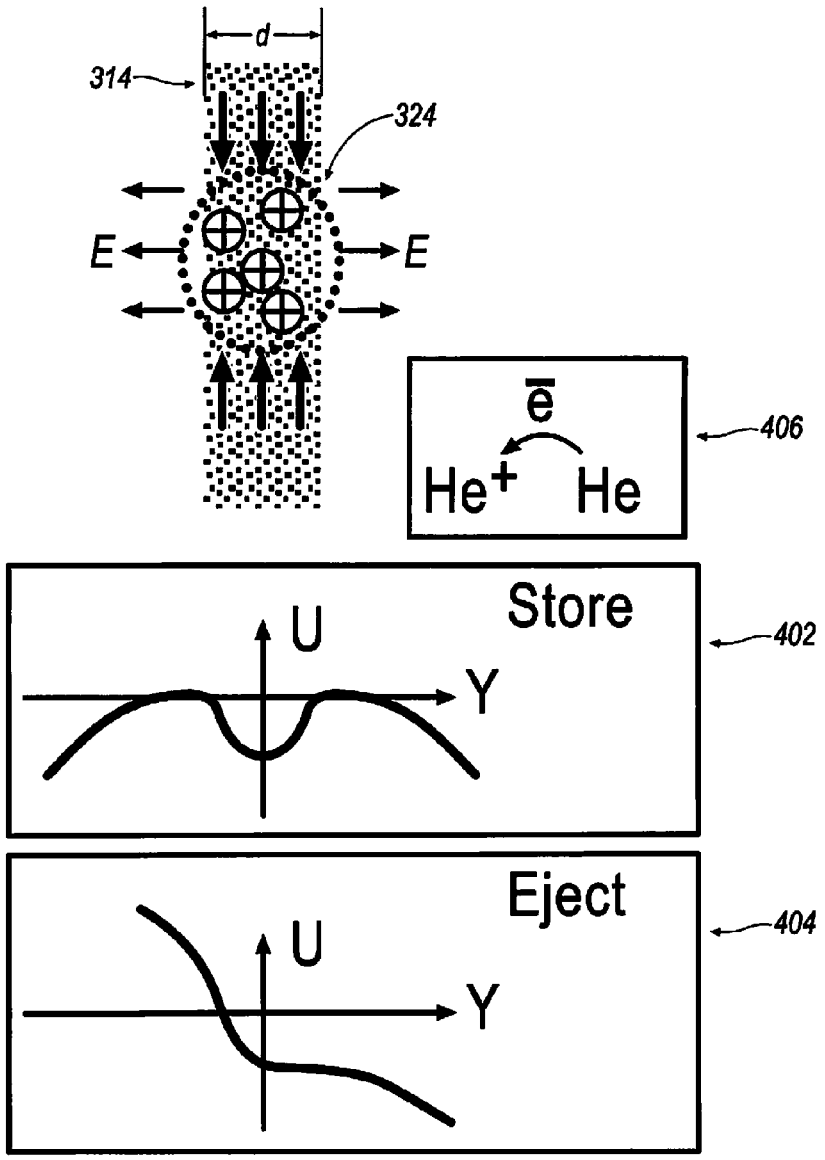
FIG. 4 is a schematic view of an electron beam and potential profiles illustrating ion accumulation within the electron beam and subsequent pulsed ion extraction.

Referring to FIG. 4, in some implementations, ion source 300 forms an ion accumulation area 324 in electron beam 314, which has a diameter d. The electron beam 314 forms a potential well 402 which may be estimated as: $D=I/\pi\epsilon_0 \upsilon d \sim 1V$. For an electron current of I=100 uA, an electron speed of $\upsilon$=4 E+6 m/s, and a beam diameter of d=1E−3 m, the potential well can be estimated as 1V.

In some implementations, during the ion accumulation stage, first electrode 318*a* (the repeller) and second electrode 318*b* (the extractor) have weak attractive potentials (e.g., few V) relative to ionization chamber 310. This creates a relatively weak quadrupolar field in the vicinity of ionization region 315 with a field strength under 1V/mm. The quadrupolar field diverges along the Y axis and converges along the X axis. The Y-diverging field has low effect on the depth of potential well 402 along the Y axis; however, the X-converging field aids confinement of ions along the X axis.

In some implementations, during the ion ejection or extraction stage, first electrode 318*a* (repeller) receives a positive pulsed potential and second electrode 318*b* (extractor) receives an attractive negative pulsed potential. To release accumulated ions, the required strength of the extraction field is greater than 1 V/mm or 5V/mm to tilt potential well 404. In some examples, the extracting field strength is less than about 20V/mm to reduce energy spread of extracted ion packets 150.

The process of ion accumulation may not spread onto Helium ions 406. A resonance charge exchange between He+ ions and He atoms as well as a resonance exchange of free slow electrons attached to He atoms may occur. The charge exchange reactions control charge motion rather than electric field. The charge on the Helium atoms may leave potential well 402, since charge motion is not governed by electric field, but rather by resonance charge exchange reactions 406 and by gas thermal energy. The effect is more likely to occur within some range of Helium gas density, wherein a constant rate of electron tunneling reactions exceeds a constant rate of ion formation.

Figure 5:
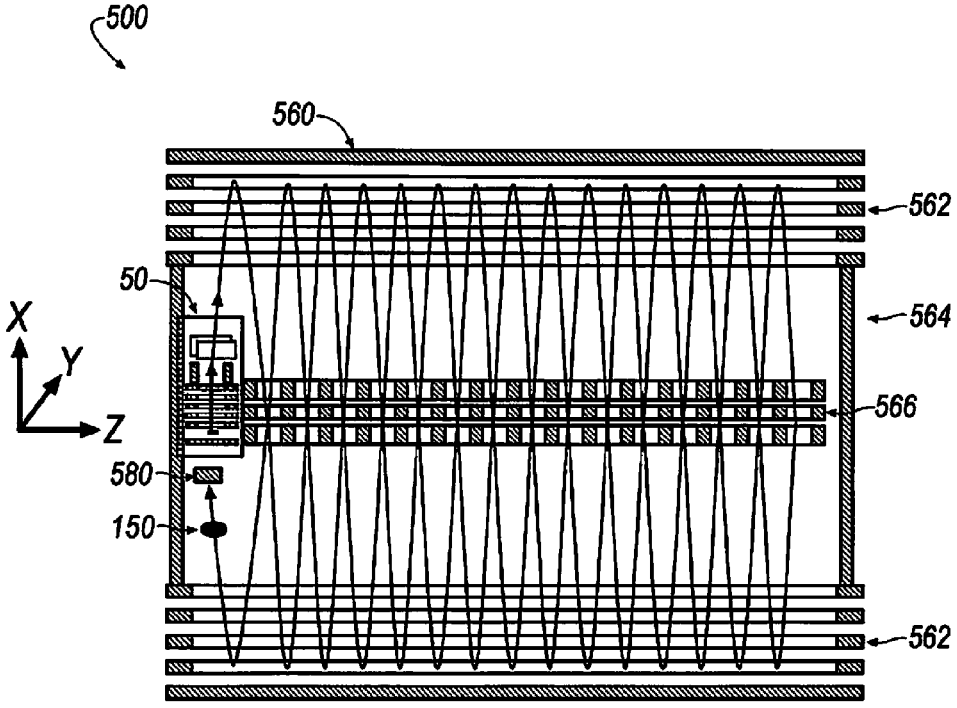
FIG. 5 is a schematic view of an exemplary electron impact ionization—time-of-flight mass spectrometer (EI-TOF MS) system.

FIG. 5 provides a schematic view of an exemplary electron impact ionization-time-of-flight mass spectrometer (EI-TOF MS) system 500, which includes an accumulating electron impact ion source assembly 50 (e.g., accumulating ion source 100, 300 with transfer ion optics 120 and an orthogonal accelerator 140), a planar multi-reflecting TOF (M-TOF) analyzer 560 and a detector 580. Planar M-TOF analyzer 560 includes two planar and gridless ion mirrors 562 separated by a field free space 564 and a set of periodic lens 566 within field free space 564.

Accumulating ion source 100, 300 accumulates ions between extraction pulses having a time period of between about 500 μs and about 1000 μs, matching ion flight time in the analyzer 560. An extraction pulse cause the extraction of an ion packet 150 along the Y axis and orthogonal accelerator 140 orthogonally accelerates ion packet 150 along the X axis. Accumulating ion source 100, 300 and optics 120 may be slightly tilted relative to M-TOF analyzer 560. Ion packets 150 are reflected between mirrors 562 of M-TOF analyzer 560 and slowly drift in Z directions while being confined by periodic lens 566 along a main zigzag trajectory.

Figure 7:
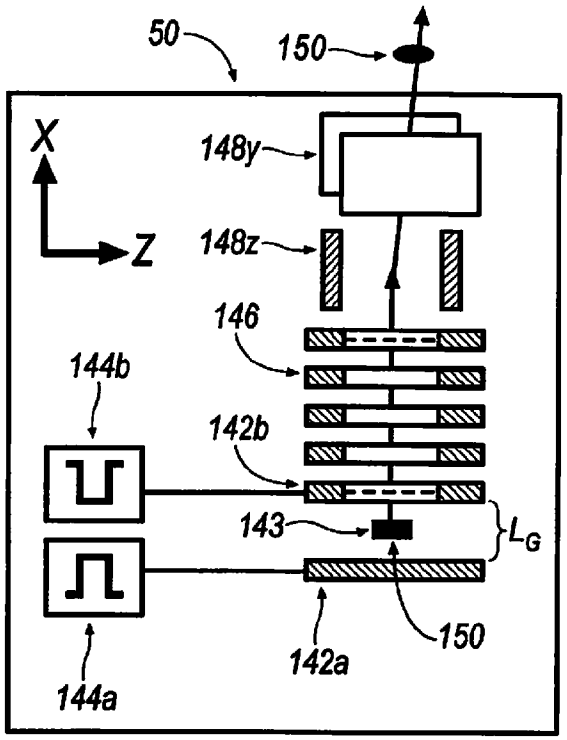
FIG. 7 is a schematic view of the accumulating electron impact ion source assembly of the system shown in FIG. 5 along an X-Z plane.
Figure 6:
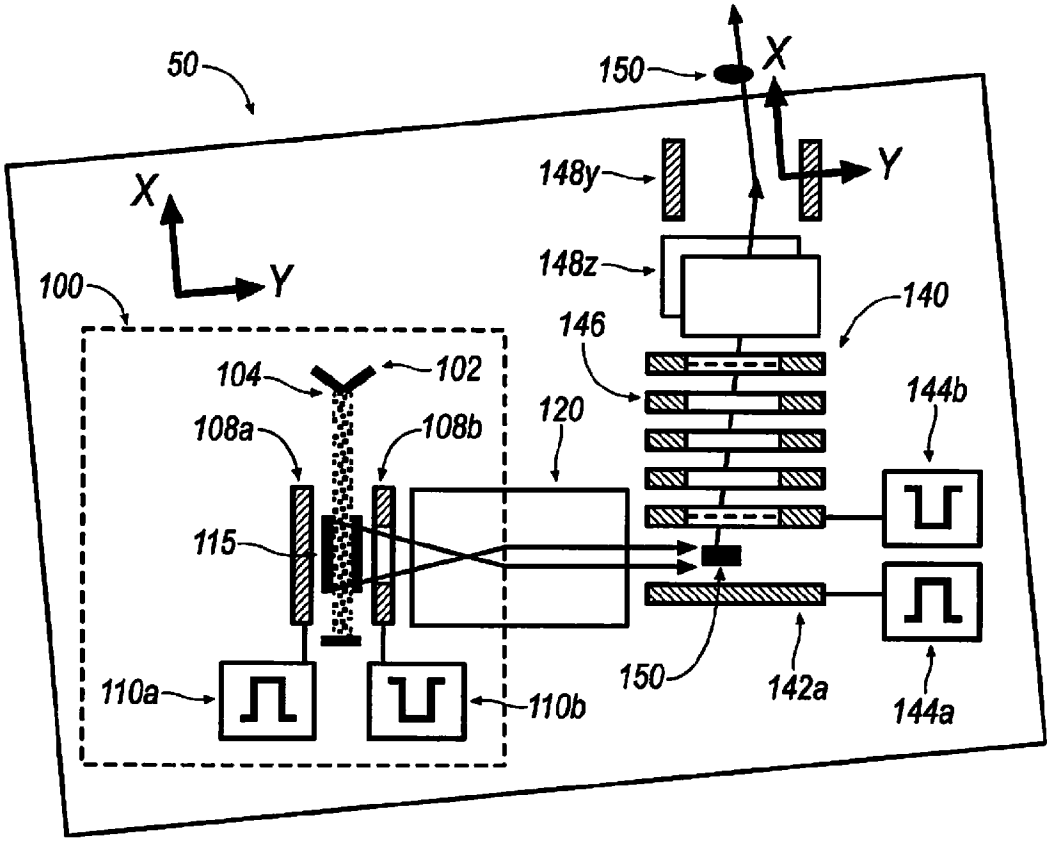
FIG. 6 is a schematic view of an accumulating electron impact ion source assembly of the system shown in FIG. 5 along an X-Y plane.

FIG. 6 provides a schematic view of accumulating electron impact ion source assembly 50 along an X-Y plane. FIG. 7 provides a schematic view of accumulating electron impact ion source assembly 50 along an X-Z plane. In the examples shown, accumulating electron impact ion source assembly 50 includes an accumulating ion source 100 having an electron emitter 102 delivering a continuous electron beam 104 into an ionization space 115 between first and second electrodes 108*a* and 108*b* connected to respective first and second pulsed generators 110*a* and 110*b*. Accumulating ion source 100 is in communication with electrostatic ion optics 120 which reduce spatial divergence of ion packets 150 extracted from accumulating ion source 100 and delivered to an orthogonal accelerator 140. Orthogonal accelerator 140 includes third and fourth electrodes 142*a* and 142*b* in electrical communication with respective third and fourth pulse generators 144*a* and 144*b*. In this case, third electrode 142*a* is a push plate receiving positive pulses from third pulse generator 144*a*, and fourth electrode 142*ba* is a mesh covered pull plate receiving negative pulses from fourth pulse generator 144*b*. In some examples, orthogonal accelerator 140 includes an electrostatic acceleration stage 146, a Z-deflector 148*z* and a Y-deflector 148*y*.

In the examples shown in FIGS. 6 and 7, orthogonal accelerator 140 is oriented orthogonal to the axis of ion optics 120. However, the entire accumulating electron impact ion source assembly 50 is oriented at an angle with respect to X, Y, and Z axes of EI-TOF MS system 500, in order to steer ion packets 150 along the zigzag trajectory of MR-TOF analyzer 560 (FIG. 5) for mutually compensating time distortions originating from tilting accumulating electron impact ion source assembly 50 and steering ion packets 150 in one or more of deflectors 148*y*, 148*z*.

Figure 8A:
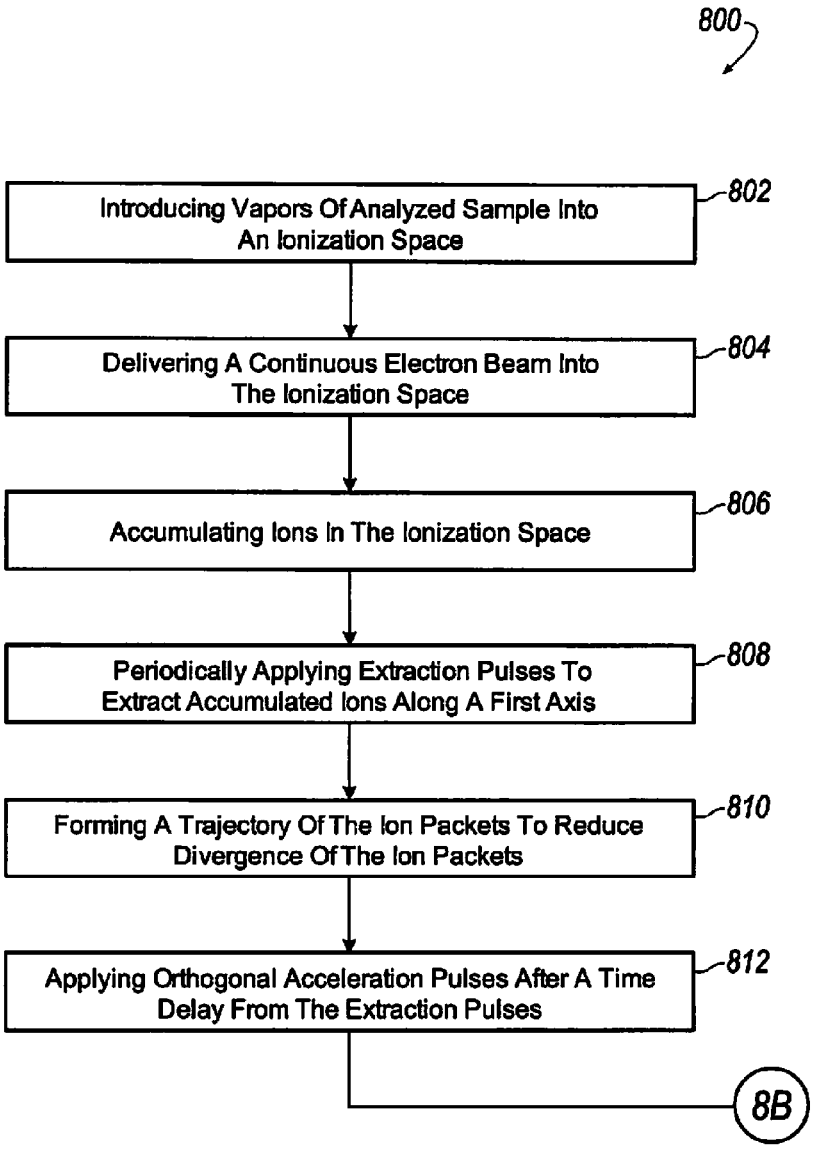
FIGS. 8A and 8B provide an exemplary arrangement of operations for operating the EI-TOF MS system.
Figure 8B:
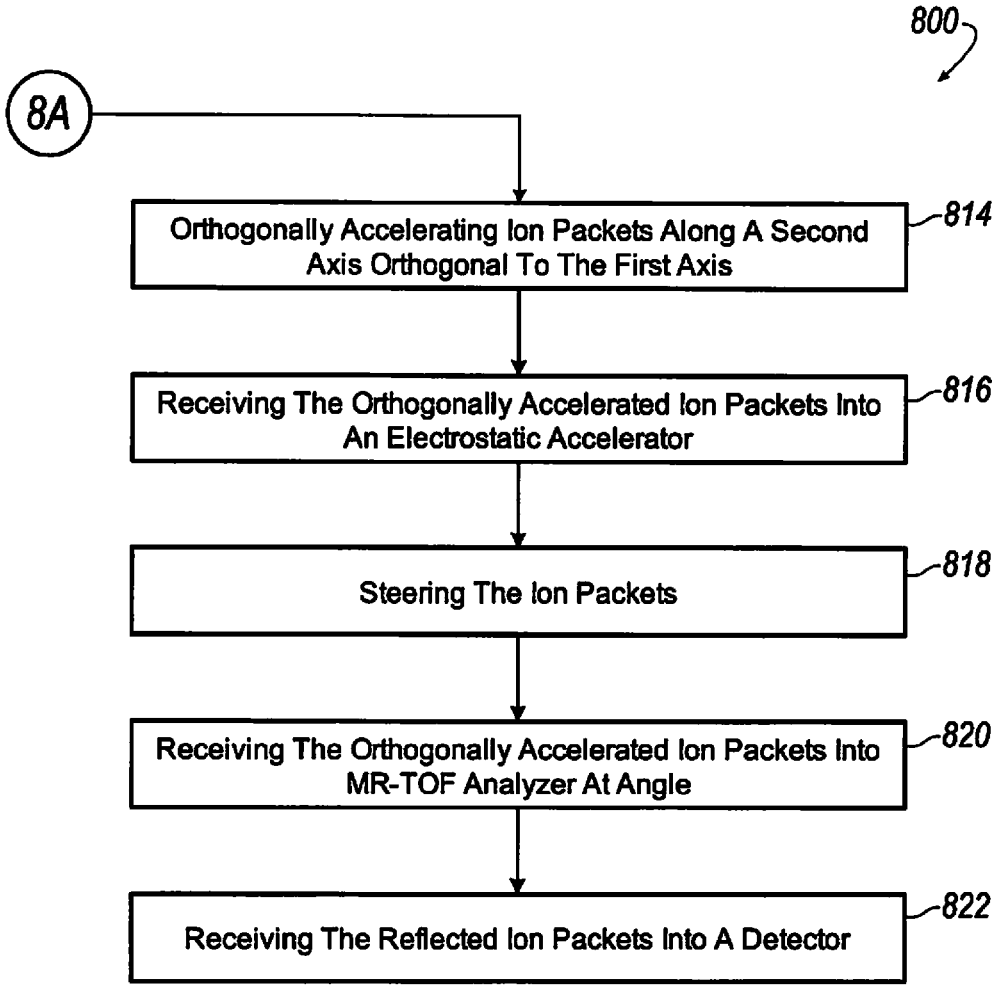

FIGS. 8A and 8B provide an exemplary arrangement 800 of operations for operating EI-TOF MS system 500. The operations include introducing 802 vapors of analyzed sample (i.e., analyte) into ionization space 115 between first and second electrodes 108 and 108*b* and delivering 804 a continuous electron beam 104 into ionization space 115 to bombard the sample and produce sample ions (e.g., ions of the analyte). For the purpose of enhancing sensitivity, the operation includes accumulating 806 ions within electron beam 104 in ionization space 115. Ion accumulation may be enhanced, for example, by forming a magnetic field (e.g., by first and second magnets 326*a* and 326*b*) to substantially confine electron beam 104 in a radial direction. In some examples, the operations include charging first and second electrodes 108*a* and 108*b* with potentials that assist ion accumulation within electron beam 104. A strength of the static quadrupolar field near electron beam 104 can be less than 1 V/mm. Packets of analyte ions 130 can be formed by applying a pulsed electric field having a strength less than 20 V/mm to electron beam 104. The operations include periodically applying 808 extraction pulses to first and second electrodes 108*a* and 108*b* to extract accumulated ions along a first axis, and forming 810 a trajectory of ion packets 130 within transfer ion optics 120 so as to reduce divergence of ion packets 130 within orthogonal accelerator 140. The operations further include applying 812 orthogonal acceleration pulses (e.g., from third and fourth generators 144*a* and 144*b*) to third and fourth electrodes 142*a* and 142*b* after a time delay from the extraction pulses and orthogonally accelerating 814 ion packets 150 along a second axis, orthogonal to the first axis. The time delay can be adjusted to attain ion packets 130 of a particular mass-to-charge ratio (m/z) for orthogonal acceleration.

The operations further include receiving 816 orthogonally accelerated ion packets 150 into electrostatic accelerator 146 along the second axis (X axis) and steering 818 ion packets 150 (e.g., in a direction along the Y axis) to mutually compensate time distortions of tilt and steering. The operations also include receiving 820 orthogonally accelerated ion packets 150 into MR-TOF analyzer 560 at an angle with respect to at least one of the axes X, Y, Z of MR-TOF analyzer 560 for steering ion packets 150 along the zigzag trajectory within MR-TOF analyzer 560. The operations include receiving 822 reflected ion packets 150 into detector 180.

EI-TOF MS system 500 may be operated with a unity duty cycle of the MR-TOF 560 with high resolution at least for a limited mass range. Moreover, ion accumulation within accumulating ion source 100 improves the duty cycle, as compared to a static mode of EI-TOF MS system 500. For the static operation mode, first and second pulsed generators 110*a* and 110*b* are switched off and weak extraction potentials are applied to first and second electrodes 108*a* and 108*b*. Then a continuous ion beam 104 passes through ion optics 120 and enter an acceleration gap 143 (FIG. 7) between third and fourth electrodes 142*a* and 142*b*. In some examples, a length $L_G$ of acceleration gap 143 is less than 6 mm, while ion energy is about 80 eV. In such cases, ions of medium mass (e.g., m/z=300) pass through orthogonal accelerator 140 in less than 1 μs. Thus, only 1 μs out of a 700 μs period can be utilized for orthogonal extraction, i.e., a duty cycle of less than 0.15% for MR-TOF 560 in a continuous mode. In the accumulating mode, extracted ion packets 150 are shorter than the length L of orthogonal accelerator 140 and ions of narrow mass range are orthogonally accelerated with nearly a unity duty cycle. The expected gain in sensitivity is estimated as 500 compared to the static operation mode of EI-TOF MS system 500.

Experimental Tests

For experimentally testing the effect of ion accumulation in EI-TOF MS system 500, a closed type accumulating ion source 300 was used with an ionization chamber 310 having an inner diameter ID of 13 mm and a length $L_C$ of 10 mm. For the experiments, a thermo electron emitter 102 provides a stabilizing emission current of 3 mA. Ionization chamber 310 samples a 100 uA current electron beam through beam entrance aperture 311 defined by ionization chamber 310. Entrance aperture 311 has a diameter $D_1$ of about 1 mm. A uniform magnet field of 200 Gauss confines electron beam 104 in ionization region 315. Extraction aperture 317 of ionization chamber 310 has a diameter $D_2$ of about 4 mm and second electrode 318*b* (e.g., a vacuum sealed extraction electrode) defines an exit aperture 319 having a diameter $D_3$ of about 2 mm. Ionization region 315 receives samples via transfer line 328 from an Agilent 6890N gas chromatograph (available from Agilent Technologies, Inc., 5301 Stevens Creek Boulevard, Santa Clara, Calif. 95051-7201) within a 0.1 to 10 mL/min flow of Helium gas. Most of the experiments correspond to a 1 mL/min Helium flow typical for GC microcolumns.

For the experiments, ionization chamber 310 floats at +80V relative to ground, and electron energy is selected in a range from between about 20 eV and about 100 eV. During the accumulation stage, first electrode 318*a* receives a repeller potential of between about 70V and about 78V (e.g., about 2-10V lower than the potential of ionization chamber 310) and second electrode 318*b* receives an extractor potential of between 0V and about 70V, accounting for low field penetration into ionization chamber 310. At the ejection stage, first electrode 318*a* receives a repeller potential of between about 80V and about 90V, and second electrode 318*b* receives an extractor potential of between 0V and about −200V (negative). The voltages may be selected for maximizing ion signal during the accumulating mode.

For the experiments, within the ion optics 120 an electrostatic lens (not shown) includes an acceleration hollow electrode at −300V defining a 1×2 mm slit, which limits angular divergence of passing ion packets 130. The slit is arranged to match the plane of ion trajectory focusing for an initially parallel ion beam. The acceleration electrode is disposed adjacent to a pair of telescopic lenses with steering elements—all floated to at least −300V. A decelerating lens disposed adjacent the telescopic lens forms a substantially parallel ion beam having a diameter less than about 2 mm and full divergence less than about 4 degrees at an ion energy of 80 eV.

A 80 eV ion beam enters orthogonal accelerator 140 with a 6 mm effective length of orthogonally sampled ion packets 150. Accumulating ion source 300, lens system 120 and orthogonal accelerator 140 are all tilted together at an angle of about 4.5 degrees with respect to the Y axis of MR-TOF analyzer 560 for the experiments. The beam is steered back onto the XZ plane past orthogonal accelerator 140. A delay between source extraction pulses and orthogonally accelerating pulses is varied to admit ions of desired mass range, wherein admitted mass range is checked in MR-TOF analyzer 560.

MR-TOF analyzer 560 is planar for the experiments and includes two parallel planar ion mirrors each composed of 5 elongated frames. Voltages on electrodes are adjusted to reach a high order of isochronous ion focusing with respect to an initial ion energy, spatial spreads, and angular spreads. A distance between the mirror caps is about 600 mm. The set of periodic lenses 566 enforces ion confinement along the main zigzag trajectory. Ions pass lenses in forward and back Z directions. An overall effective length of the ion path is about 20 m for the experiments. An acceleration voltage of 4 kV is defined by the floating field free region 564 of MR-TOF analyzer 560. The flight time for heaviest ions of 1000 amu can be 700 μs.

In the continuous operation mode, the duty cycle of EI-TOF MS system 500 can be about 0.25% for relatively heavy mass-to-charge ratio (e.g., m/e=1000) and drops proportional to the square root of a smaller ion mass-to-charge ratio. EI-TOF MS system 500 may have a resolution of 45,000-50,000 for relatively heavy ions.

Figure 9A:
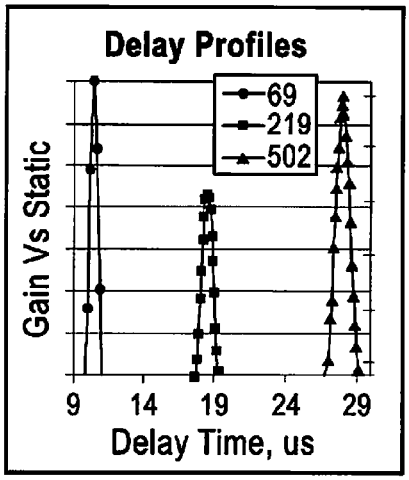
FIGS. 9A and 9B each provides a graphical view of exemplary mass span profiles during operation of an EI-TOF MS system.
Figure 9B:
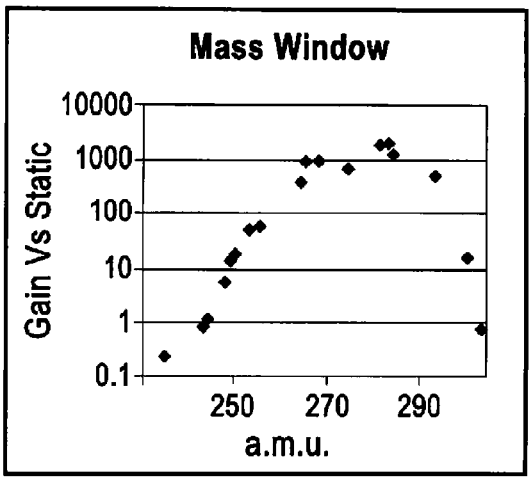

FIGS. 9A and 9B each provides a graphical view of exemplary mass span profiles during operation of EI-TOF MS system 500. Accumulating ion source 300 was operated in the accumulation mode with pulsed ion extraction and FIG. 9A shows time profiles of ion packets 150 within orthogonal accelerator 140 for ions having a mass-to-charge ratio m/e=69, 219 and 502. The full width on half maximum (FWHM) for ion packets 150 past accumulating ion source 300 is 0.5 μs for mass 69 and increases proportional to the square root of the mass-to-charge ratio, m/e. The width is limited by time spent in orthogonal accelerator 140 rather than by an initial duration of extracted ion packets 150 from accumulating ion source 300. As a result, an entire ion packet 150 of a desired m/e can be caught within orthogonal accelerator 140 at the moment of orthogonal acceleration and the duty cycle of orthogonal accelerator 140 becomes close to unity. By accumulating ions within accumulating ion source 300, (pulsed mode) the sensitivity of EI-TOF MS system 500 can be improved by factor of several hundreds compared to the static (continuous) operation mode of EI-TOF MS system 500. The time for focusing ion packets 150 in orthogonal accelerator 140 may inevitably shrink the analyzed mass range, due to time-of-flight effects between accumulating ion source 300 and orthogonal accelerator 140.

FIG. 9B provides a graphical view of a mass range for a time delay of 21 μs with a logarithmic vertical scale. The useful mass range is ~15 amu at 280 amu median mass. In a typical GC-TOF analysis, the time delay has to be preset with a GC retention time. However, GC separation is generally reproducible in time and most wide spread GC-MS analyses are primarily concerned with detection of known ultra traces.

Figure 10A:
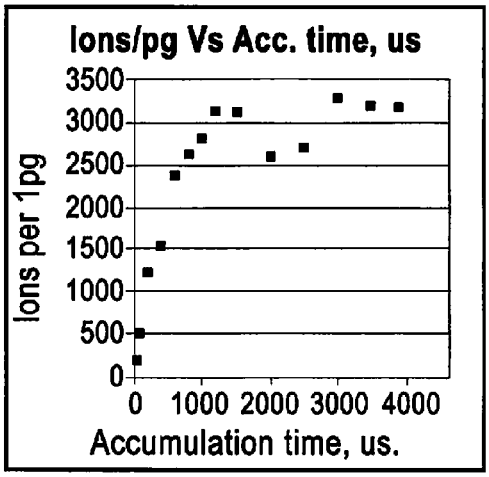
FIG. 10A provides a graphical view of ion signal intensity within a EI-TOF MS system versus ion accumulation time in an accumulating ion source for a 1 pg injection of hexachloro benzene $C_6Cl_6$ (HCB) onto a gas chromatography (GC) column.

FIG. 10A provides a graphical view of ion signal intensity within EI-TOF MS system 500 versus ion accumulation time in accumulating ion source 300 for a 1 pg injection of hexachloro benzene $C_6Cl_6$ (HCB) onto a GC column. As shown, the intensity of the ion signal grows over a duration of ion accumulation. The signal is measured as number of molecular ions (282-290 amu range) at MR-TOF analyzer 560 per 1 pg of Hexa-Cloro-Benzene C6Cl6 (HCB) loaded onto a GC column. The graph illustrates that the number of accumulated ions grows with accumulation time up to 1 ms and then saturates at a time greater than 1 ms.

Figure 10B:
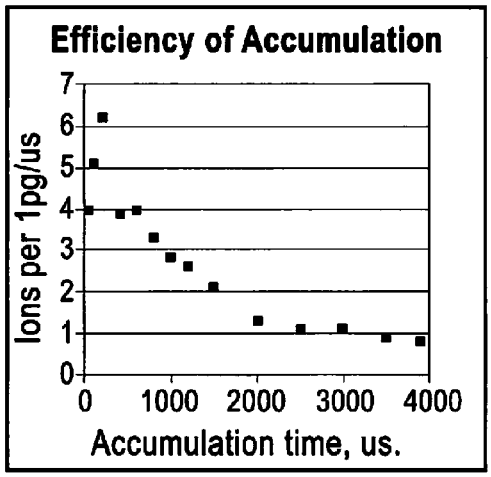
FIG. 10B provides a graphical view of a time differential of the graph shown in FIG. 10A, illustrating efficiency of ion accumulation in time.

FIG. 10B provides a graphical view of a time differential of the graph shown in FIG. 10A, illustrating efficiency of ion accumulation in time. Maximum efficiency is observed at 200-400 μs and reaches 6 ions per microsecond per 1 pg of HCB loaded onto a GC column.

Figure 11A:
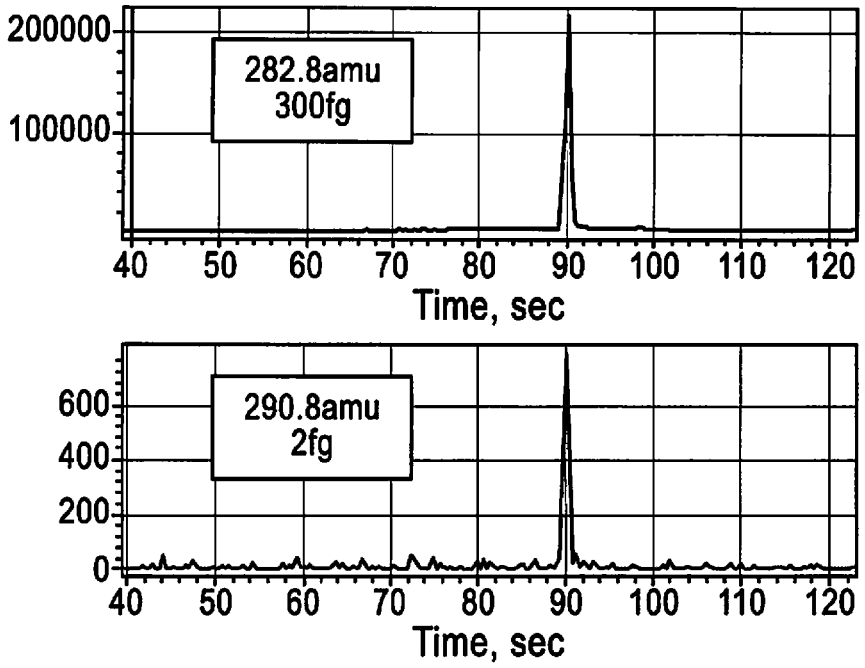
FIG. 11A provides a graphical view of experimental traces of isotopes of HCB obtained from a 1 pg injection of HCB into an EI-TOF MS system.

FIG. 11A provides a graphical view of experimental traces of isotopes of HCB obtained from a 1 pg injection of HCB into the EI-TOF MS system 500 (e.g., into ionization region 315). The time traces of individual ion chromatograms are shown for ions of 282.81+/−0.005 amu and 290.90+/−0.005 amu. The traces present minor isotopes of HCB: isotope of 282.8 amu has a 30% abundance and isotope 290.8 amu has a 0.2% abundance of a molecular isotope cluster. The GC trace of 290.8 amu isotope with a 2 fg effective load demonstrates an excellent smooth shape with signal to noise ratio S/N exceeding 50. EI-TOF MS system 500 in a pulsed operation mode can reach a sensitivity of 100,000 molecular ions per 1 pg of HCB loaded onto GC column.

Figure 11B:
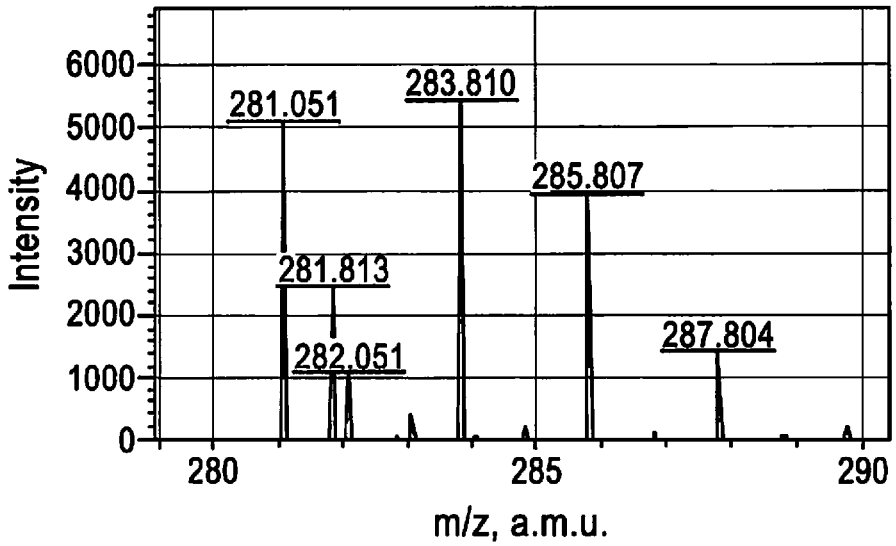
FIG. 11B provides a graphical view of a segment of mass spectrum obtained at a 1 pg injection of HCB into an EI-TOF MS system while employing ion accumulation in an accumulating ion source.

FIG. 11B provides a graphical view of a segment of mass spectrum obtained at a 1 pg injection of HCB into EI-TOF MS system 500 (e.g., into ionization region 315) while employing ion accumulation in accumulating ion source 300. A resolving power of the presented spectrum is 35,000. Although resolution at a 280 amu mass range is somewhat limited by detector frequency bandwidth, the resolution still exceeds 35,000-40,000, which allows separation of analyte peaks from chemical background peaks that are presented by 281.05 and 282.05 amu peaks of GC column bleeding. High resolution analysis substantially improves the ability of detecting ultra traces. Including a chemical background into a mass spectral peak of a low resolving mass spectrometer results in an intensive baseline with statistical variations of base intensity. As a result, chemical noise concentration primarily affects the detection limit rather than absolute sensitivity of the instrument. The limitation may strongly depend on chemical diversity and complexity of the sample matrix. Assuming maximum possible sensitivity of the instrument with 100% transmission and a maximum efficiency of EI ionization equal to 1E−4, the 0.1 fg/sec flow of 281 amu may produce 6 E+3 ions/sec. At a minimum required acquisition speed of 20 spectra/sec, the intensity of 281 amu ion may correspond to 300 ions per spectrum. A two sigma statistical variation of the signal can be estimated as 30 ions/spectrum, which corresponds to 0.01 fg/sec flow. Thus, the minimum signal with S/N>10 may correspond to 0.1 fg/sec.

In practical analyses, the chemical background of realistic matrix may be higher by many orders of magnitude which shifts the detection limit to a picogram level. In some examples, a detection limit of 100 ions on the top of the single ion noise may correspond to a 0.1-1 fg detection limit which can be highly independent of matrix concentration, since analyte compounds are mass resolved from the chemical background.

Figure 12A:
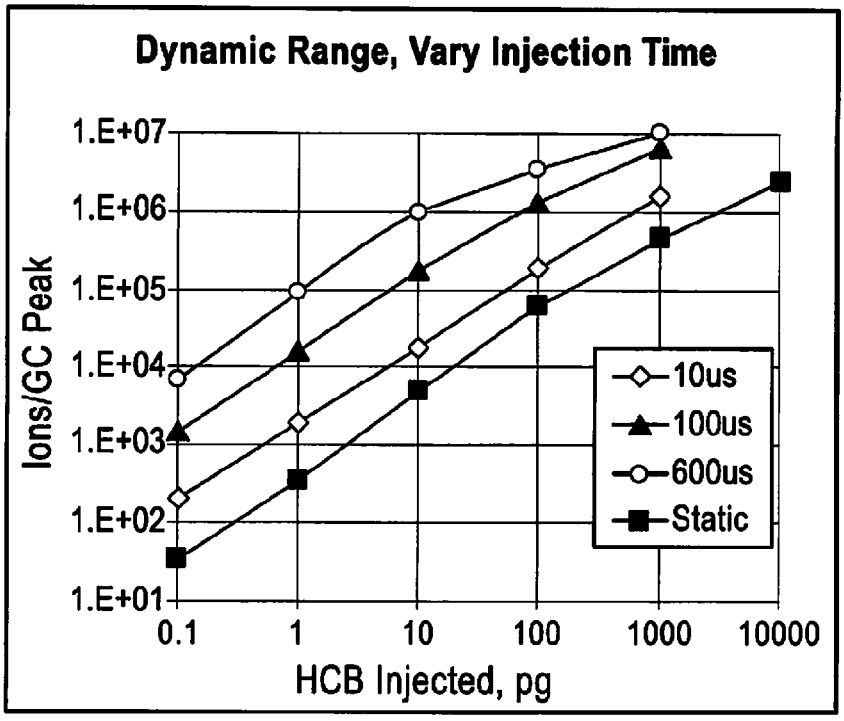
FIG. 12A provides a graphical view of a dynamic range plot at various modes of operation of an accumulating ion source within an EI-TOF MS system.

FIG. 12A provides a graphical view of a dynamic range plot at various modes of operation of accumulating ion source 300 within EI-TOF MS system 500. A number of ions on detector 580 is plotted versus an amount of HCB sample injected onto a GC column for injection into accumulating ion source 300. Employed modes include static extraction of continuous ion beam from ion source 300 and ion accumulating regimes of ion source 300 with accumulation times of 10 us, 100 us and 600 us. For presenting dynamic range of EI-TOF MS system 500 a signal of molecular isotopic cluster of HCB is plotted versus amount of sample injected onto a GC column. In the static mode of source operation (i.e., with continuous extraction of ions from accumulating ion source 300) the signal is proportional to an amount of injected sample, from 1 to 1000 pg, and the sensitivity is 300 ions/pg. At higher injected amounts (e.g., above 1000 pg) the signal exhibits signs of saturation. Thus, dynamic range is 4 orders of magnitude.

In the accumulating mode, the signal may depend on ion accumulation time. For an accumulation time of 10 μs, the signal is approximately 5-10 times larger, at an accumulation time of 100 μs, the signal is approximately 50-100 times larger, and at an accumulation time of 600 μs, the signal is 300 times larger—all compared to the static operation mode. However, the maximum observed signal starts saturating at the level of 1E+6 ions per GC peak. Saturation may be imposed by accumulating ion source 300 itself. Calibrated defocusing of the ion beam after accumulating ion source 300 induces proportional signal changes for all operation modes, which excludes effect of saturation of MR-TOF analyzer 560 and detector 580. In some instances, lowering the electron emission current shifts the signal saturation to a region of higher sample loads.

Figure 12B:
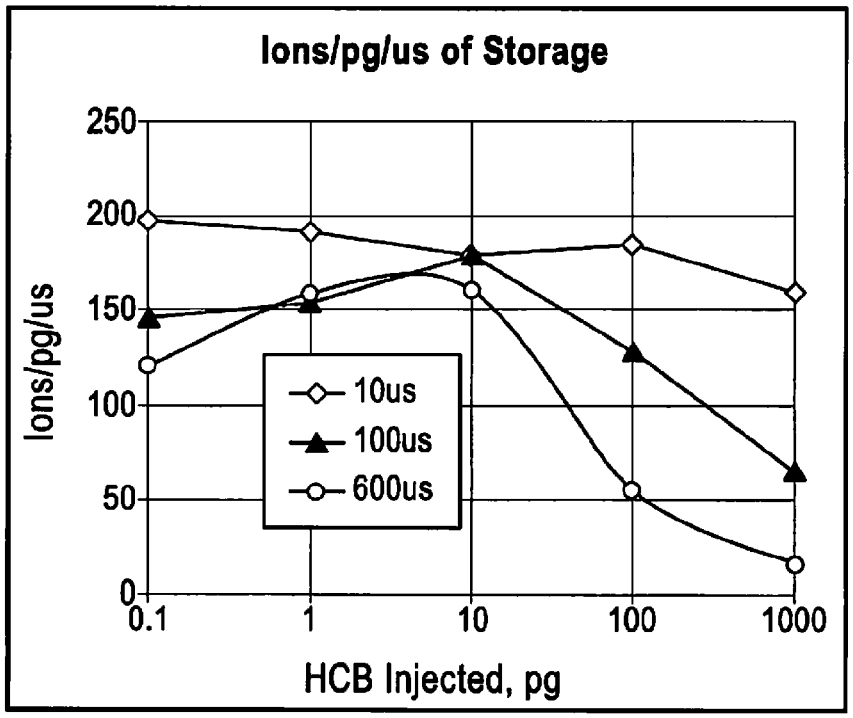
FIG. 12B provides a graphical view of saturation during ion accumulation. A number of ions per 1 μs of ion storage and per 1 pg of HCB is plotted versus amount of HCB sample loaded onto a column.

FIG. 12B provides a graphical view of saturation during ion accumulation. A number of ions per 1 μs of ion storage and per 1 pg of HCB is plotted versus amount of HCB sample loaded onto a column. The graph shows that the number of ions per 1 μs of ion storage and per 1 pg loaded saturates at higher sample loads. The saturation occurs at 1000 pg for 10 μs accumulation, at 100 pg for 100 μs accumulation time and, at 10-100 pg for 600 μs accumulation time.

At relatively low sample loads, the accumulating mode improves the sensitivity of EI-TOF MS system 500 up to 300 fold to the level of 100,000 ions/pg. Accumulating ion source 300 may be employed for detection of ultra traces at femtogram and sub-femtogram levels.

Shrinking an admittance mass range can be advantageous for ultra sensitive analysis in the accumulating mode. Alternatively, admission of the entire mass range may cause detector saturation by strong background components. Admission of a relatively narrow mass range may cause additional complications, but can be acceptable for GC-MS analyses when presetting the analyzed mass range per GC retention time for analysis of known impurities at so-called target analysis.

The mass span can be increased by altering a delay between the extraction pulse(s) on first and second electrodes 318*a* and 318*b* of accumulating ion source 300 and the orthogonal acceleration pulse(s) on third and fourth electrodes 142*a* and 142*b* of orthogonal accelerator 140. Although, the delay between the extraction pulse and the orthogonal acceleration pulse may cause signal loss in proportion to the mass range expansion, sensitivity remains much higher compared to the static operation mode. For example, for a 150 amu window, the gain remains about 30.

At a relatively low sample concentration, the sensitivity is roughly proportional to the accumulation time, which may be used for calibrated beam attenuation and for increasing dynamic range of the analysis.

At a relatively higher concentration, saturation of the signal and a drop of sensitivity may occur. The saturation may also occur at relatively smaller sample loads for longer accumulation times. Moreover, saturation may be triggered by the total sample content. Thus, analysis of small traces in the presence of strong GC peaks of a co-eluting chemical matrix may result in sensitivity discrimination. For example, saturation can occur for a sample load above 10-30 pg/sec. For matrixes having about a microgram total load, individual matrix compounds can be expected at the level of a few nanograms. Thus, the time overlapping with sample matrix peaks may cause 10-30 fold suppression of the instrument sensitivity in the accumulating mode.

In some implementations, a method of avoiding signal suppression by chemical matrices includes separating the sample within two-dimensional GC×GC chromatography so as to provide momentary separation of ultra traces from the matrix. In other implementations, a method of avoiding signal suppression by chemical matrices includes pulsing the accumulating ion source 300 every 10-50 μs. In examples using MR-TOF analyzer 560, the method includes synchronizing the orthogonal acceleration pulses by orthogonal accelerator 140 with the extraction pulses of accumulating ion source 300. To avoid overlapping mass peaks in MR-TOF analyzer 560, the method may include separating a narrow mass range at an early stage of time-of-flight analysis. For example, the method may include selecting a narrow mass range, e.g., by a pulsed deflection within Z-deflector 148Z, and employing a principle of beam side to side sweeping.

A number of implementations have been described. Nevertheless, it will be understood that various modifications may be made without departing from the spirit and scope of the disclosure. Accordingly, other implementations are within the scope of the following claims.

What is claimed is:

1. An ion source for a time-of-flight mass spectrometer, the ion source comprising:

a sample injector introducing sample vapors into an ionization space;

an electron emitter providing a continuous electron beam into the ionization space to generate one or more packets of analyte ions; and an orthogonal accelerator receiving the packets of analyte ions along a the first axis and periodically accelerating the packets of analyte ions along a second axis that is substantially orthogonal to the first axis;

wherein for the purpose of enhancing sensitivity and resolution, first and second electrodes arranged spaced apart in the ionization space for accumulating analyte ions within the electron beam, the first and second electrodes receiving periodic extraction pulsed potentials to accelerate packets of analyte ions from the ionization space along the first axis; and wherein a time delay between the extraction of each packet of analyte ions along the first axis and the acceleration of each respective packet of analyte ions along the second axis is generally proportional to the square root of a median mass to charge ratio of orthogonally accelerated ion packets.

2. The ion source of claim 1, wherein the electron emitter accelerates the electron beam to energy between about 25 eV and about 70 eV.

3. The ion source of claim 1, wherein the electron emitter provides a current of at least 100 μA to said ionization space.

4. The ion source of claim 1, wherein the sample injector introduces a carrier gas at a flow rate of between about 0.1 mL/min and about 10 mL/min to maintain gas pressure in the source between about 1 mTorr and about 10 mTorr.

5. The ion source of claim 1, further comprising an ionization chamber enclosing the ionization space and defining first and second opposing electron apertures for receiving the electron beam, the ionization chamber defining an extraction aperture along the first axis for extraction of analyte ion packets (closed source), and wherein the extraction aperture has a diameter of between about 2 mm and about 4 mm.

6. The ion source of claim 1, further comprising an electron collector arranged opposite of the electron emitter to receive the electron beam, the electron collector positively biased compared to the electron emitter for allowing extraction of slow electrons from the ionization space.

7. The ion source of claim 1, further comprising transfer ion optics arranged to receive analyte ion packets from the ionization space and pass the analyte ion packets along the first axis, the transfer ion optics reducing divergence of the analyte ion packets in the orthogonal accelerator.

8. The ion source of claim 7, wherein said transfer ion optics comprise an electrode having an accelerating voltage of at least 300V and an aperture defining ion beam focusing.

9. The ion source of claim 1, further comprising a multi-pass time-of-flight analyzer for analyzing flight time of the analyte ion packets accelerated along the second axis.

10. The ion source of claim 9, wherein the multi-pass time-of-flight analyzer comprises a multi-reflecting planar time-of-flight analyzer having periodic lenses.

11. The ion source of claim 1, wherein the sample injector comprises a gas chromatograph or a two-dimensional gas chromatograph.

12. A method of a time-of-flight mass spectrometric analysis, the method comprising:

introducing sample vapors into an ionization space;

ionizing the sample vapors with a continuous electron beam delivered into the ionization space to generate analyte ions; and orthogonally pulsed accelerating the analyte ion packets along a second axis substantially orthogonal to the first axis;

wherein for the purpose of enhancing sensitivity and resolution of the analysis, the electrostatic field in the ionization space is arranged to accumulate ions within the electron beam;

wherein electric pulsed electric field is applied for pulse extracting packets of accumulated analyte ions out of the ionization space along a first axis;

wherein the extraction of the ion packets is synchronized with the orthogonal acceleration of the ion packets with a time delay therebetween; and wherein the time delay is proportional to square root of median mass to charge ratio of thus orthogonally accelerated analyte ion packets.

13. The method of claim 12, further comprising accelerating the electron beam to energy between about 25 eV and about 70 eV.

14. The method of claim 12, further comprising delivering a current of at least 100 μA of the electron beam to the ionization space.

15. The method of claim 12, further comprising introducing the carrier gas into the ionization space at a flow rate of between about 0.1 mL/min and about 10 mL/min to maintain gas pressure in the source between about 0.1 mTorr and about 10 mTorr.

16. The method of claim 12, further comprising a step of adjusting the amplitude of said extraction pulses to provide a time-of-flight focusing of ion packets within the orthogonal accelerator.

17. The method of claim 12, further comprising spatially focusing the analyte ion packets between extraction of analyte ion packets along the first axis and prior to their orthogonal acceleration.

18. The method of claim 17, further comprising passing the analyte ion packet through an aperture defined by an electrode having an accelerating voltage of at least −300V prior to step of orthogonal acceleration.

19. The method of claim 12, further comprising a step of mass analyzing said orthogonally accelerated ion packets within electrostatic field of either a singly reflecting or a multi-pass time-of-flight mass analyzer.

20. The method of claim 19, further comprising a step of adjusting the accumulating time within the electron beam for either enhancing the dynamic range of the analysis or for reaching best compromise between sensitivity of the analysis and the saturation of electron beam at higher sample loads.

21. The method of claim 12, further comprising chromatographically separating the sample vapors before introducing the sample vapors into the ionization space.

22. The method of claim 12, further comprising ionizing the sample vapors in a closed type ion source.

23. The method of claim 12, further comprising ionizing the sample vapors in an open type ion source.

24. The method of claim 23, wherein the distance between the accumulating electron beam and orthogonal accelerating field is smaller than the length of the orthogonally accelerating field in the first direction.

25. The method of claim 12, wherein accumulating analyte ions comprises forming an electrostatic quadrupolar field to substantially confine accumulated analyte ions in a direction of electron beam.

26. The method of claim 25, wherein the strength of the electrostatic quadrupolar field near the electron beam is less than 1 V/mm.

27. The method of claim 12, wherein a product of a period of time for accumulating analyte ions and a flux of the sample vapors is less than 1 pg to avoid suppression of ion accumulation.

* * * * *

UNITED STATES PATENT AND TRADEMARK OFFICE

CERTIFICATE OF CORRECTION

PATENT NO. : 9,048,080 B2
APPLICATION NO. : 13/817519
DATED : June 2, 2015
INVENTOR(S) : Anatoly N. Verenchikov et al.

It is certified that error appears in the above-identified patent and that said Letters Patent is hereby corrected as shown below:

In the Claims:

At column 12, claim number 1, line number 52, after the phrase ions along a, delete the word "the".

Signed and Sealed this
Twenty-second Day of September, 2015

Michelle K. Lee

Michelle K. Lee
*Director of the United States Patent and Trademark Office*